United States Patent [19]

Zöllner et al.

[11] Patent Number: 4,840,718

[45] Date of Patent: Jun. 20, 1989

[54] INERT COMPOSITE ELECTRODE, IN PARTICULAR AN ANODE FOR MOLTEN SALT ELECTROLYSIS

[75] Inventors: Christine Zöllner; Herbert Hahn, both of Nuremberg, Fed. Rep. of Germany

[73] Assignee: C. Contradty Nürnberg GmbH & Co. KG, Röthenbach, Fed. Rep. of Germany

[21] Appl. No.: 921,677

[22] Filed: Oct. 21, 1986

[30] Foreign Application Priority Data

Oct. 22, 1985 [DE] Fed. Rep. of Germany ..... 3537575

[51] Int. Cl.[4] ..... C25B 11/00; C25C 7/02; C25D 17/10

[52] U.S. Cl. ..... 204/286; 204/288; 373/93

[58] Field of Search ..... 204/286, 287, 288, 67–70, 204/243 R; 373/91, 92, 93, 94, 101

[56] References Cited

U.S. PATENT DOCUMENTS

| | | | |
|---|---|---|---|
| 3,761,384 | 9/1973 | Ruthel et al. | 204/286 |
| 3,984,304 | 10/1976 | Rahn | 204/286 |
| 4,357,226 | 11/1982 | Alder | 204/286 |
| 4,462,088 | 7/1984 | Kozil et al. | 204/286 |
| 4,462,887 | 7/1984 | Koziol et al. | 204/286 |

*Primary Examiner*—John F. Niebling
*Assistant Examiner*—Ben C. Hsing
*Attorney, Agent, or Firm*—Wolf, Greenfield & Sacks

[57] ABSTRACT

An inert composite electrode, such as an anode, for molten salt electrolysis consists of an active part in the form of a plurality of bar-shaped active elements, in particular of ceramic oxide, which are arranged with their longitudinal axes mutually parallel and in mutually aligned groups, an electrode holder which comprises a current-conducting plate, with one main surface of which the active elements are in firm contact with their end surfaces, and a joining arrangement which joins the active elements together in groups and holds them in contact with the plate.

This composite electrode is characterized in that the active elements each have a head section adjacent to the plate which is widened in the direction of the end surfaces adjacent to the plate substantially in a wedge shape considered in cross-sections lying perpendicular to the line of alignment of a group, and in that a clamping element has a wedging surface which is brought into contact with each of the two oppositely-lying wedging surfaces of the head section of the respective active element, the wedging angle of the clamping element substantially corresponding to that of the respective wedging surface of the head section.

17 Claims, 3 Drawing Sheets

INERT COMPOSITE ELECTRODE, IN PARTICULAR AN ANODE FOR MOLTEN SALT ELECTROLYSIS

This application claims the benefit of West German Patent Application No. P 35 37 575.2 filed Oct. 22, 1985.

BACKGROUND OF THE INVENTION

The invention relates to an inert composite electrode, in particular an anode for molten salt electrolysis, e.g. for the extraction of aluminium, magnesium, sodium, lithium, etc., consisting of an active part in the form of a plurality of bar-shaped active elements, particularly of ceramic oxide, which are arranged with their longitudinal axes mutually parallel and in mutually aligned groups, an electrode holder which comprises a current conducting plate with one major surface of which the electrode elements are in firm contact with their end surfaces, and a coupling arrangement which connects the active elements together in groups and holds them in contact with the plate.

In molten salt electrolysis, e.g. for production of aluminium, intensive development is in progress to employ so-called inert anodes, which consist in particular of ceramic oxide, instead of self-consuming anodes of carbon.

A series of advantages provides an incentive for this development:

In manufacture and in operation, the inert anode shows energy savings.

In addition, raw material is saved. In the manufacture, it is unnecessary to have recourse to the fossil material petroleum, from which then petrol, carbon and pitch is produced. In operation of the inert anode, no consumption or only a very slight consumption of anode material occurs. As a result, furthermore the investment and operational costs for the anode plant are avoided.

Since anode replacement which is regularly necessary with consuming anodes can be avoided, the cells can be operated in a closed condition. The working conditions are therefore improved.

The exhaust gas from the cells contains either sulphur dioxide or polyaromatic hydrocarbons. The fluorides can more easily be extracted from the closed exhaust system.

Finally, inert anodes can be operated with higher current densities than carbon electrodes. As a result, the production capacity is increased with a smaller area and/or in less time.

Constructively, the inert electrodes must on the one hand overcome the handicaps of the already existing cells equipped with carbon electrodes. This applies in particular with reference to the current feed and the arrangement and/or the dimensioning of the active components of the anode. But on the other hand, of course also the requirements which result from the material from which the active parts of the inert anodes consist, must be taken into account. This applies in particular with reference to the physical parameters and the manufacturing technology.

An inert composite electrode of the type defined in the introduction is known from DE-PS No. 30 03 922. This consists in essence of an active part, an electrode holder and an arrangement for connecting the two first-named constructional groups together.

The active part is formed from a plurality of bar-shaped active elements. These are arranged with their longitudinal axes parallel to one another and in mutually aligned groups. The overall cross-section perpendicular to the longitudinal axes of the active elements corresponds approximately to the corresponding cross-section of conventional carbon electrode for molten salt electrolysis cells. The individual active elements consist of a ceramic oxide material. For holding the active elements and for current feed to these, a tubular carrier is provided. In this, a further tube is concentrically arranged whose lower end is provided with a bottom plate. This bottom plate has a central hole through which a bar-shaped current feed is introduced whose lower end, finishing beneath the bottom plate, is provided with a current supplying pressure plate. With this pressure plate, the upper end surfaces of the active elements are brought into firm mechanical and electrical contact. For this purpose, the grouped and active elements each have in their upper section a respective hole which is likewise aligned to that of another group. Through these mutually aligned holes a suspension rod is put in each case, the ends of which contact a support plate. This support plate and the said bottom plate are braced by screw bolts whereby the upper end surfaces of the active elements are brought into contact with the current feeding pressure plate. If necessary, between the end surfaces of the active elements and the pressure plate, an intermediate layer having good electrical conductivity can be inserted.

This known electrode construction has several severe disadvantages.

First of all, its construction is as a whole relatively complicated, in particular with reference to the suspension rods which are put through the holes in the head section of the active elements and must be mounted and braced accordingly.

Furthermore, the manufacture of the holes in the head sections of the active elements requires considerable manufacturing expediture. They can only be produced in the green condition of the ceramic oxide active elements. Furthermore, holes are associated with greater tolerances, in particular having regard to the alignment of the active elements arranged in groups, since such tolerances occur already in the manufacture of the active elements in the green condition and furthermore further dimensional changes unavoidably occur during sintering of the active elements. This has the consequence that the holes of one group of active elements are not exactly aligned so that some of the active elements placed in a row on a suspension rod fail to make contact or make only insufficient contact at their end surfaces with the current feeding plate of the electrode holder. This applies then all the more so in operation where the various expansion coefficients of the material of the active elements on the one hand and the current feeding plate on the other hand have a pronounced negative effect on the contact between the end surfaces of the active elements and the plate. This results in increased voltage drop with the consequence that the electrical efficiency drops.

This disadvantage is exacerbated in that the holes reduce the cross-sectional area parallel to the longitudinal axes of the active elements, that is to say in the cold region of the active elements. As a result, the current paths are restricted there.

The mentioned weakening of the cross-section of the active elements of the known anode also reduces the mechanical strength of the active elements and this in a region in which on the one hand the respective suspension rod exerts an increased force on the material of the active elements as a result of its prestressing and on the other hand also the highest tension forces appear as a result of the weight of the active elements. As a result of this, the largest mechanical stresses occur just in the region of the weakest cross-section of the active elements so that an increased danger of fracture of the electrode elements occurs at the said position.

Finally, in the known anode construction there is no or little attention directed to the necessary electrolyte movement in the region of the lower section of the electrode elements inserted into the melt and to the gas discharge in the region of the electrode elements.

SUMMARY OF THE INVENTION

It is an object of the invention to provide an inert composite electrode of the above-described type in which the ceramic oxide active elements are constructed with regard to the material and manufacturing technology for ceramic oxides, and which possesses a simple construction and is easily assembled and has good electro-chemical efficiency.

This object is achieved with an inert compound electrode having the features mentioned in the introduction, in that the active elements each have a head section adjacent to the plate which, in cross-section perpendicular to the line of alignment of a group and in the direction of the end surface towards the plate, is widened substantially in the shape of a wedge and a clamping element having a wedging surface is brought into contact with each of the two oppositely lying wedge surfaces of the head section of the respective active element, the wedge angle of which clamping element substantially corresponds to that of the respective wedging surface of the head section so that a dovetail joint results.

The active part of the anode according to the invention is thus divided into a plurality of bar-shaped active elements such as known per se. The active elements are favourably configured from the point of view of manufacturing technology because the wedge-shaped head section of the configuration is adapted to ceramic technology whereas in contrast the bores provided in the head section of the active element of the known anode present a series of problems from the point of view of manufacturing technology as explained above.

In the assembled condition, the active elements in the region of the wedging force are subjected exclusively to compression which can easily be resisted by the ceramic oxide material as a result of its high compression strength. In addition, the cross-section in the pressure-loaded region of the active elements is enlarged as a result of the wedge shaped of the head section. As a consequence of the cross-sectional enlargement in the loaded region of the active elements, also the tension forces as a result of the weight of the active elements can be effectively resisted. There results an anode construction which is mechanically very stable.

The wedge or dovetail clamping of the active elements by means of the described clamping elements results also in a self-adjusting effect with the consequence that all the active elements make intimate conact at their end surfaces with the current supplying plate, that is to say that any existing manufacturing tolerances are overcome or levelled out. As a result of the self-adjusting wedging force between the active elements on the one hand and the clamping elements or the plate on the other hand, moreover, any possible movements of the constructional elements relative to one another as a result of the various thermal expansion co-efficients of the materials are equalised so that also in operation of the anode intimate contact of the end surfaces of the active elements with the clamping elements and the current-supplying plate is maintained. In this manner, an enduring and both electrically and mechanically optimal connection between the metallic current feed and the ceramic active elements is ensured.

As a result, the voltage drop between the current-feeding plate and the end surfaces of the active elements is minimized.

Moreover, in the anode according to the invention, the current transfer plane between the current-feeding plate and the active elements are enlarged in that the clamping elements are likewise in electrical connection both with the plate and also with the wedging surfaces of the electrode elements so that the latter correspondingly enlarge the overall contact surface of the active elements with reference to the current-supplying component. As a result of the enlarged overall contact surface, the voltage drop is also accordingly reduced.

As a result of the already mentioned cross-sectional enlargement in the head section of the active elements, i.e. in the cold region of the same, the current supply is decisively improved in this critical position. The area exploitation of the anode according to the invention is also very good, since the curent lines have a certain lateral spread and the effective anode surface is approximately equal to the projected anode area.

Since the anode elements consist of a material having hot conductor properties, appropriate measures for increasing the conductivity are decisive for increasing the electrical efficiency in the cold, i.e. non-conducting region of the anode elements, that is to say increase of the cross-section in the head section of the anode elements, special treatment of the material of the anode elements for increasing the conductivity, and enlarged current transfer surfaces. Everything considered, the anode arrangement according to the invention thus has very good electro-chemical efficiency.

Between the active elements arranged in groups, channels are provided between the active elements at least in the positions where the clamping elements are present. On he one hand the melt and the electrolyte can circulate in these channels in the region of the lower section of the active elements inserted into the melt or into the electrolyte, whereby reduction of concentration of the electrolyte, which might otherwise occur, can be effectively countered. On the other hand, these channels make sufficient space available for gas discharge, so that the gas evolved can be rapidly discharged. Both lead to an increase in the electro-chemical efficiency of the process carried out with the electrodes according to the invention.

Expedient constructions of the compound electrode according to the invention are set forth in the remaining claims.

Thus, for example, the active elements of a group may be in mutual contact along their line of alignment. Thus, channels are only provided between the active elements where clamping elements are present between the active elements. As a result, on the one hand a very compact construction of the active part of the anode according to the invention results on the other hand however, sufficient acccount is also taken of corresponding movement of the melt and of the electrolyte as well as gas discharge.

As a result of the wedge-shaped widening of the head section of the active elements the voltage drop in the cold region is already extensively reduced. Yet, it can still be recommendable to ensure that the electrical conductivity of the material of the active elements in the region of the head section is higher than in the remaining region, since this material has hot conductor properties. This is possible, for example, by providing that the material of the active elements in the region of the head section is a cermet, which preferably is tin oxide containing silver. By this means, the current conductivity in the critical head section of the active elements is still further improved in the electrode according to the invention.

In order still further to reduce the voltage drop between the current conducting plate and the active elements, it can be of advantage that between the relevant main surface of the plate and the corresponding end surfaces of the active elements a contact layer is applied. This can be formed by a net of good-conducting metal, in particular copper.

There can be provided for each aligned group of active elements a respective through-going clamping element or a separate clamping element. It is however also possible that the clamping element for securing two opposite-lyingg active elements is constructed for two neighbouring groups and for this purpose has two oppositely lying wedging surfaces having substantially a mirror symmetrical arrangement. This reduces further the expenditure in manufacture and in assembly.

The mentioned clamping element can expediently be constructed to be trapezium-shaped in cross section perpendicular to the line of alignment of the groups of active elements.

Furthermore, to each active element a respective pair of separate clamping elements can be assigned and the length of one clamping element may correspond in the main to the length of an active element.

It is however also possible that for each group of active elements a respective pair of through-going clamping elements is provided on full length of the current conducting plate and the length of one clamping element substantially corresponds to the length of a group of active elements.

For rapid assembly and disassembly, it is recommendable that the clamping elements are fixed by means of screws to the plate.

To prevent corrosion as a result of the aggressive gases present in the cells and the high temperatures, it is naturally expedient to protect both the regions of the current conducting plate directed towards the cell interior, and also the clamping elements including their securing elements by means of covering elements of corrosion-resisting material. Possibilities for this purpose are ceramic-graphite composite materials for example clay-graphite.

Finally, it is of considerable advantage to cool the current conducting plate. By this it is possible to bring the electrode holder as close as possible to the melt and in spite of this to maintain the temperature at the contact between the plate and the active elements below 250° C. This is particularly necessary if the anode is operated with higher current loading since as is known the temperature of the electrode increases quadratically with current load. Preferably, the cooling should be so arranged that approximately 30% to 35% of the overall heat is extracted via the anode upper surface. The advantage of positioning the electrode holder as close as possible is of course that the active elements can thereby be short, whereby on the one hand expensive material can be saved and on the other hand the voltage drop in the active elements is further reduced.

Expediently, the cooling of the plate is effected by water cooling, for which purpose the plate is constructed as a hollow body within which channels are arranged for the cooling water. Finally, in this case, it is expedient if the respective current feed to the plate is guided through the interior of the hollow body and is electrically connected to the interior side of the main surface with which the active elements are in contact.

BRIEF DESCRIPTION OF THE DRAWINGS

Further advantages and details of the compound electrode according to the invention may be seen from reference to the description of the drawings and the explanation of a special exemplary embodiment.

In the drawings.

DETAILED DESCRIPTION OF THE INVENTION

The inert electrode according to the invention, in particular an anode for molten salt electrolysis, consists substantially of three constructional groups, that is to say an active part designated as a whole with 10, an electrode holder designated as a whole with 30, and an arrangement for joining the two first named constructional groups, designated as a whole with 40.

Figure 1:
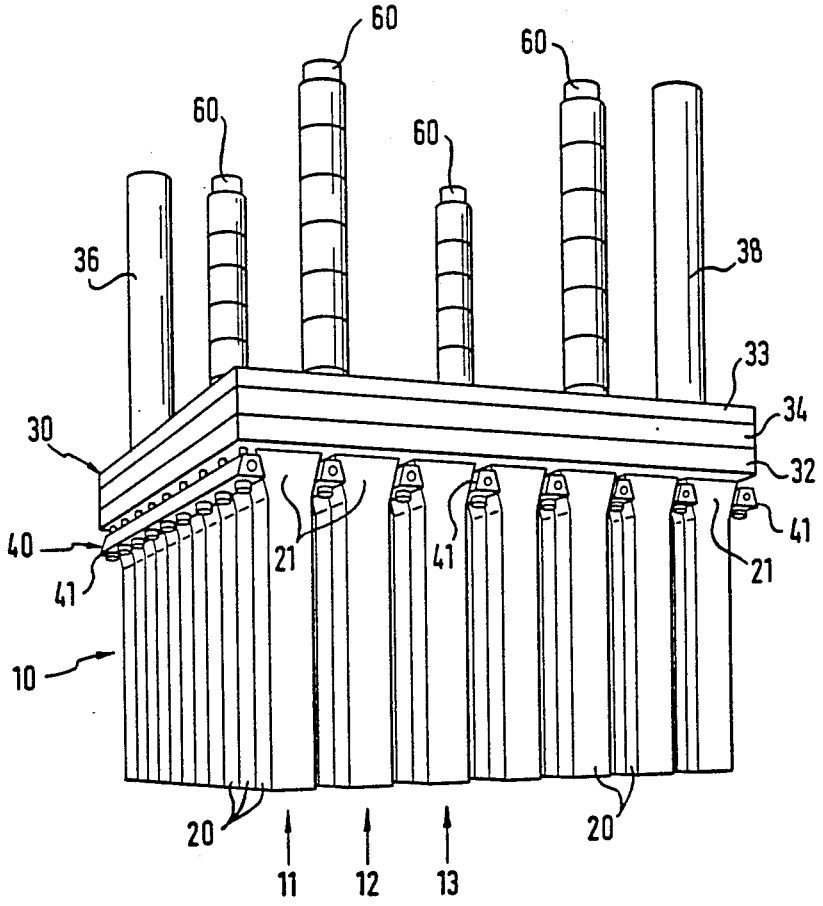
FIG. 1 shows a perspective representation of an exemplary embodiment of the compound electrode according to the invention.
Figure 2:
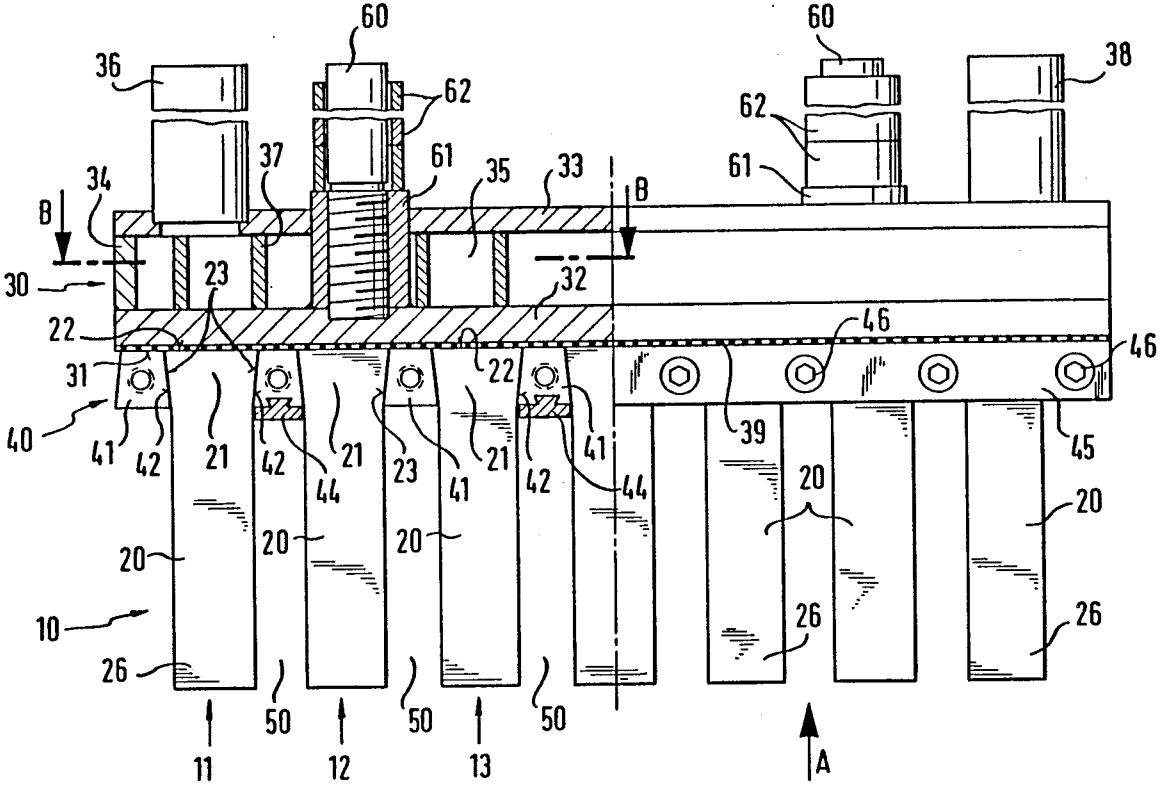
FIG. 2 shows a partially sectioned side view of the composite electrode according to the invention.
Figure 3:
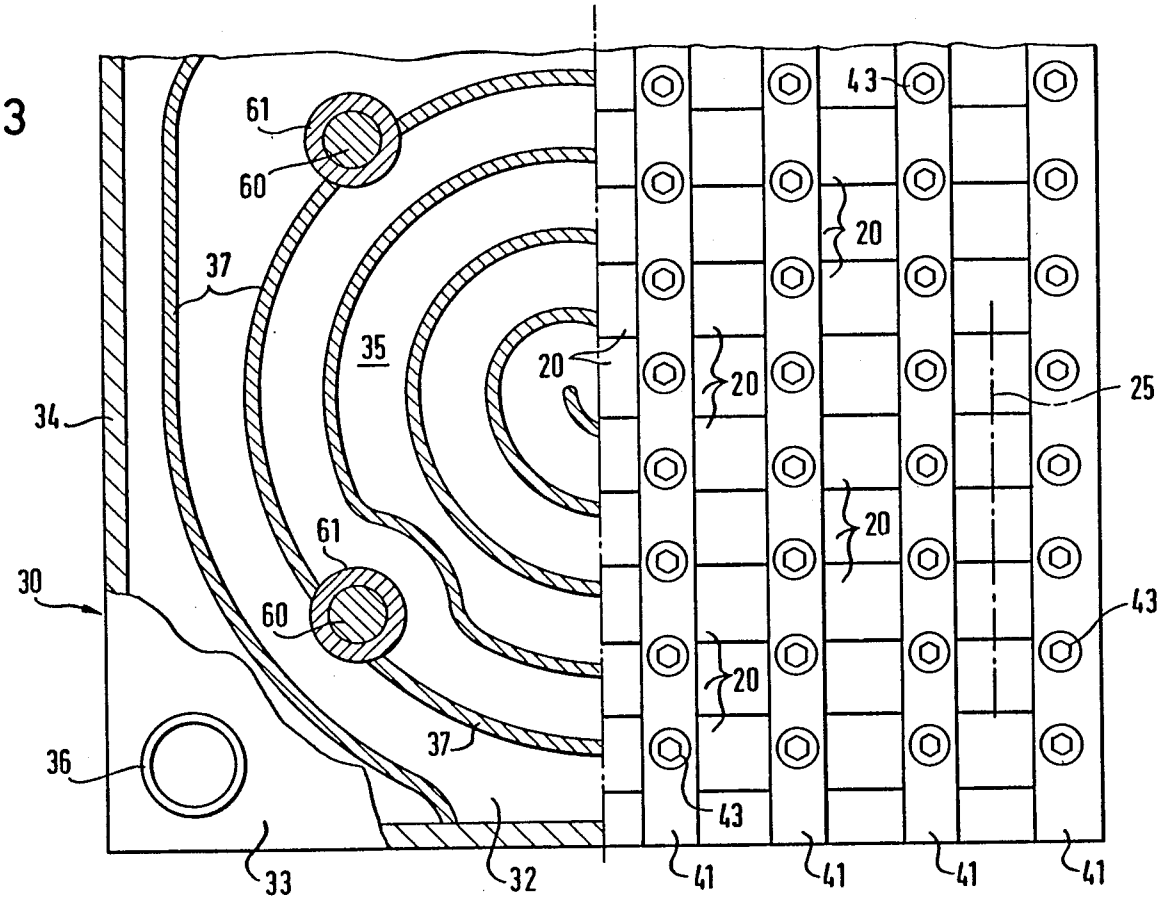
FIG. 3 shows the view A and the section B-B according to FIG. 2.

The active part consists of a plurality of bar-shaped active elements which are designated with 20. These are arranged with their longitudinal axes mutually parallel and vertically directed in the assembled position in the cell and are arranged in groups 11, 12, 13 etc. mutually aligned along the alignement line 25 (FIG. 3). They are substantially square or rectangular in cross-section pependicular to their longitudinal axes. They consist of an electrically-conducting and electro-chemically active ceramic oxide material which will be described in more detail. Each active element 20 has a respective head section 21 which is widened to provide wedging surfaces 23 in its cross-section lying perpendicular to the line of alignment of the relevant group and parallel to the corresponding end surface 22.

The substantially plate-shaped electrode holder 30 comprises a downwardly directed main surface 31—as seen in the assembled position in the electrode cell—on which the active elements 20 are held mechanically and electrically in contact at their end surfaces 22. This is achieved with the aid of clamping elements 41 representing the joining arrangement 40. These clamping elements are trapezoidally constructed in their cross-section extending parallel to the longitudinal axis of the active element 20 and perpendicualr to the line of alignment of any group, in such manner that the two oppositely-lying wedging surfaces 42 are in contact with the equal-angled wedging surfaces 23 of two oppositely-lying active elements 20 in two neighbouring groups, e.g. 12, 13, with corresponding force application. For this purpose, the clamping elements 41 are screwed by means of screws 43 to the plate-shaped electrode holder 30.

By means of the clamping elements 41, two neighbouring groups 11, 12, 13 etc. of active elements are so spaced that channels 50 are formed which in the described manner enable circulation of the electrolyte or the melt between lower sections 26 of the active elements 20 inserted into the melt or into the electrolyte and which on the other hand ensure rapid upward discharge of the gas evolved in the electrolysis process between the active elements 20 arranged in groups.

The plate-shaped electrode holder 30 is constructed as a hollow body, consisting of a lower horizontal plate 32, an upper plate 33 arranged parallel to the first, and side walls 34 perpendicular thereto. The hollow chamber serves for circulation of cooling water in the interior chamber 35 of the electrode holder 30. For this purpose, a cooling water feed tube 36 is provided which discharges at the periphery of the interior chamber 35. Along spiral-shaped guide walls 37, the cooling water circulates through the interior chamber 35 of the plate-shaped electrode holder 30 until it reaches the central region and from there passes into the peripheral region from where the correspondingly heated cooling water is withdrawn via a cooling water discharge tube 38.

The plate-shaped electrode holder 30 is equipped furthermore with a plurality of current feed bolts 60 via which the electrical current is supplied to the plate-shaped electrode holder 30 and from there is transferred to the electrode elements 20. For connecting the current feed bolts 60 to the lower plate 33 of the electrode holder 30, on the inner surface of the lower plate 33 respective sockets 61 are welded which have an internal thread into which lower externally threaded sections of the corresponding current feed bolts 60 are screwed. In order to protect the current feed bolts 60 in the region of the interior chamber of the cell from corrosion, this is surrounded with protection sleeves 62 of corrosion resistive material.

In order still further to improve the electrical contact between the end surfaces 22 of the active elements 20 and the surface 31 of the plate-shaped electrode holder, a net 39, for example of copper, is provided between these surfaces.

The plate-shaped electrode holder 30 and the clamping element 41 as well as its tightening screws 43 consist expediently of steel. They can also consist of nickel or of steel or nickel alloys.

For protecting these components against corrosion, cover elements are provided. The cover elements 44 arranged on the lower side of the clamping elements, are secured onto the clamping elements 41, e.g. by means of a dovetail guide. The lateral covers 45 may be screwed to the end surfaces of the clamping elements 41 by means of screws 46.

The active elements 20 expediently consist of doped ceramic oxide, for example, tin oxide, nickel ferite or yttrium oxide.

For example, the composition may be as follows:

94.1 atomic per cent tin oxide
3.8 atomic per cent copper
2.1 atomic per cent antimony In a special exemplary embodiment of the anode according to the invention, the following dimensions of the bar-shaped active elements have proved to be expedient:

Cross-section of the upper end surface: 3×3 cm
Cross-section of the lower end surface: 2×2 cm
Length: 25 cm
Wedging angle: 20 degrees
Spacing between two neighbouring groups of electrode elements: 1.5 cm The side length of the upper cross-section can expediently lie between about 2 and 6 cm. The length of the active elements can lie between about 15 cm and about 40 cm. The mentioned spacing between two groups of active elements can lie between about 1 cm and about 2 cm. The wedging angle of the head section of the respective active element can be between about 5 degrees and about 25 degrees.

The described exemplary embodiment of the anode according to the invention was driven in an electrolyte test cell with the following operational parameters:

| | | |
|---|---|---|
| Bath composition: | cryolite | 84 weight % |
| | $AlF_3$ | 5 weight % |
| | $Al_2O_3$ | 10 weight % |
| | $CaF_2$ | 1 weight % |
| Temperature: | 980–1000° C. | |
| Applied voltage: | 4–5 volts | |
| Current strength: | 30 amps | |
| Current density in the anode: | 2 $A/cm^2$ | |
| Current density in the cathode: | 0.14 $A/cm^2$ | |
| Electrode spacing: | 3 cm | |
| Depth of insertion of the anodes | 2 cm | |

We claim:

1. In an inert composite electrode for molten salt electrolysis consisting of an active part in the form of a plurality of bar-shaped active elements (20) having end surfaces (22) and which are arranged in one or more mutually aligned groups and with their longitudinal axes mutually parallel, an electrode holder which comprises a current feed plate (30), having one main surface (31) in firm contact with the active elements at their end surfaces, and a connecting arrangement which connects the active elements together in groups and holds the active elements in contact with the plate, the improvement comprising:

the active elements (20) each have a respective head section (21) adjacent to the current feed plate (30), which section is widened in the direction of the end surface (22) adjacent to the plate substantially in a wedge shape with two oppositely-lying wedging surfaces (23), wherein the plane of said wedge-shape lies perpendicular to a line of alignment (25) along which the respective group of elements is aligned, and at least one clamping element (41) having at least one wedging surface (42) is brought into contact with each of the two oppositely-lying wedging surfaces (23) of the head section (21) of the respective active element (20), wherein the wedging angle of the clamping element substantially corresponds to that of the respective wedging surface of the head section.

2. Composite electrode according to claim 1, wherein the active elements (20) of one group are in the mutual contact along their line of alignment (25).

3. Composite electrode according to claim 1 or 2, wherein the electrical conductivity of the material of the active elements (20) is higher in the region of the head section (21) than in the remaining regions.

4. Composite electrode according to claim 3, wherein the material of the active elements (20) in the region of the head section (21) is a cermet.

5. Composite electrode according to claim 1, wherein a contact layer (39) is provided between the one main surface (31) of the plate (30) and the corresponding end surfaces (22) of the active elements (20).

6. Composite electrode according to claim 5, wherein the contact layer is formed by a net (39) of copper.

7. Composite electrode according to claim 1, wherein the clamping element (41) has two oppositely-lying wedging surfaces (42) with a substantially mirror-symmetrical arrangement to secure the active elements of two groups whose elements lie opposite the clamping element.

8. Composite electrode according to claim 7, wherein the clamping element (41) is trapezium-shaped in cross-section, said cross-section lying perpendicualr to the line of alignment (25) of the groups of the active elements.

9. Composite electrode according to claim 1, wherein the length of the clamping element (41) substantially corresponds to the length of one active element (20).

10. Composite electrode according to claim 1, wherein the length of the clamping element (41) substantially corresponds to the length of one group of active elements (20).

11. Composite electrode according to claim 1, wherein the clamping element (41) is secured to the current feed plate (30) by means of screws (43).

12. Composite electrode according to claim 11, wherein the clamping element (41) including their securing and screws (43) are protected by cover elements (44, 45) of a corrosion-resistant material.

13. Composite electrode according to claim 1, further comprising means for cooling the current feed plate (30).

14. Composite electrode according to claim 13, wherein the cooling means includes cooling water.

15. Composite electrode according to claim 14, wherein the current feed plate (30) is constructed as a hollow body within which channels for the cooling water are arranged.

16. Composite electrode according to claim 15, wherein at least one current feed (60) is provided for the current feed plate which is guided through the interior of the hollow body and is electrically connected to an interior side of the one main surface (31) of the current feed plate with which the active elements (20) are in contact.

17. Composite electrode according to claim 1, wherein the active elements comprise a ceramic oxide.

* * * * *